US008371347B2

(12) United States Patent
Cameron

(10) Patent No.: US 8,371,347 B2
(45) **Date of Patent: *Feb. 12, 2013**

(54) GOLF CLUB HEAD COVER WITH STORAGE

(75) Inventor: Don T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 834 days.

This patent is subject to a terminal disclaimer.

(21) Appl. No.: 12/019,241

(22) Filed: Jan. 24, 2008

(65) Prior Publication Data

US 2009/0188593 A1 Jul. 30, 2009

(51) Int. Cl.
*A63B 57/00* (2006.01)

(52) U.S. Cl. ..... 150/160; 150/154; 206/315.4; 206/37; 206/579; 473/256; D21/754

(58) Field of Classification Search ..... 150/160, 150/154; 206/315.2, 579
See application file for complete search history.

(56) References Cited

U.S. PATENT DOCUMENTS

| | | | | |
|---|---|---|---|---|
| 3,295,236 | A | 1/1967 | Wishnia | |
| 3,574,963 | A | 4/1971 | Rosenow | |
| 4,869,365 | A * | 9/1989 | Perdue et al. | 206/315.5 |
| 4,898,222 | A | 2/1990 | Gaffney | |
| 5,094,283 | A | 3/1992 | Lawrence | |
| 6,095,214 | A | 8/2000 | Gaffney | |
| 6,443,851 | B1 * | 9/2002 | Liberatore | 473/256 |
| 6,484,771 | B2 * | 11/2002 | Kloos et al. | 150/160 |
| D469,835 | S | 2/2003 | Bradshaw | |
| 6,513,165 | B1 | 2/2003 | England et al. | |
| 6,546,981 | B2 | 4/2003 | Cameron | |
| 6,820,282 | B1 | 11/2004 | England et al. | |
| 2003/0173009 | A1 | 9/2003 | Choe | |
| 2007/0068611 | A1 * | 3/2007 | Hwang | 150/160 |

* cited by examiner

*Primary Examiner* — Anthony Stashick
*Assistant Examiner* — Cynthia Collado
(74) *Attorney, Agent, or Firm* — Michael J. Mancuso

(57) ABSTRACT

A golf club head cover with storage includes a cover body, a closure flap and a pocket. The cover body defines an interior cavity configured to receive a club head. A first portion of the closure flap is fixed relative to the cover body and a second portion of the closure flap is movable between a closed position and an opened position. In the closed position, the closure flap covers an opening of the interior cavity of the cover body. The pocket is disposed on the closure flap.

17 Claims, 8 Drawing Sheets

GOLF CLUB HEAD COVER WITH STORAGE

FIELD OF THE INVENTION

This invention generally relates to golf club head covers, and more specifically to golf club head covers that provide storage for small items.

BACKGROUND OF THE INVENTION

Golfers typically carry a set of clubs in a golf bag with the club handles inserted into the bag. This causes the heads to extend out of the open end of the bag and to repeatedly strike and batter each other when the bag is moved from place to place and when the clubs are removed and inserted into the bag. "Sock" and "sleeve" types of golf club covers have been constructed for protecting the heads of the clubs. Sock covers generally have an elastic neck to hold them in place over the club head when the club is in the bag. In some cases, a draw string type of fastener is employed to secure the cover over the head and to prevent it from being accidentally removed.

During a round of golf, golfers utilize various small items. For example, they utilize ball markers, pencils, score cards, divot repair tools, etc. Generally, a golfer will utilize the majority of the tools while playing on the green or immediately thereafter. However, the items are generally kept in a pocket of a golf club bag that is kept off of the green, and often on a golf cart. Commonly, golfers forget to retrieve the required items from their golf bag prior to walking onto the green. As a result, a golfer that has forgotten necessary items is required to return to their bag to retrieve the items. Undoubtedly, in those instances, the ball has come to rest on the side of the green opposite the golfer's bag. As a result, the golfer is required to either circle the perimeter of the green or traverse the green, thereby adding significant inconvenience and exposing the green to unnecessary foot traffic.

Additionally, storing the small items in the pocket of a golf bag presents disadvantages. The pockets on golf bags are often voluminous and intended to store large items. As a result, it is often difficult to find a small item in the large pockets. Additionally, when the small items are stored with large items they are often concealed by the large item.

Alternatively, some golfers keep those small items in their pockets. Although keeping the items in their pocket may avoid the need to return to their bag to retrieve forgotten items, keeping the items in their pockets often subjects the golfer to discomfort throughout a round.

Storage mechanisms have been added to golf club head covers so that items may be stored in a location more convenient than pockets of a golf bag. One example is U.S. Pat. No. 5,094,283 to Lawrence for a Golf Club Head Cover with Article Storage Pocket. The Lawrence patent discloses an elongate cylindrical sleeve golf club cover that includes an exterior pocket for storing items such as tees, markers, scorecards, pencils, balls and other small items.

Another example is U.S. Pat. No. 6,484,771 to Kloos et al. for Golf Club Cover. The Kloos patent discloses a cover for the head of a golf club that is constructed from a single piece of stretchable fabric. A pocket is coupled to the outer surface of the cover and is sized to receive a turf comb and a cord coupling the turf comb to the pocket. The cord is provided so that if the turf comb slips from the pocket it is not lost.

It is desirable to provide a club head cover including storage that stores the small items in a convenient and secure location.

SUMMARY OF THE INVENTION

The invention is directed to a cover for a golf club head that includes storage for small items. The inventive head cover provides storage for small items that is convenient for a golfer to access and that minimizes the likelihood that the golfer will forget to retrieve the items. The inventive head cover also provides security for the small items so that the items are not inadvertently lost. Several embodiments of the present invention are described below.

In an embodiment, a golf club head cover generally includes a cover body, a closure flap, a pocket, a cover closure and a pocket closure. The cover body defines an interior cavity that is sized to receive at least a portion of the club head of a golf club. The closure flap includes a first portion that is coupled to the cover body and a second portion that is movable between a closed position and an opened position. In the closed position, the closure flap covers an opening to the interior cavity so that the cover body and the closure flap define a closed interior volume. The pocket is disposed on the closure flap and includes an opening that is disposed in the closed interior volume when the closure flap is in the closed position. The cover closure releasably retains the closure flap in the closed position and the pocket closure releasably retains the pocket closed.

In another embodiment, a golf club head cover includes a cover body, a closure flap, a pocket, a magnetic cover closure and a pocket closure. The cover body defines an interior cavity. The closure flap includes a first portion that is fixed to the cover body and a second portion that is movable relative to the first portion and the cover body between a closed position and an opened position. In the closed position, the closure flap covers an opening to the interior cavity of the cover body so that the cover body and the closure flap define a closed interior volume. In the opened position, the closure flap is positioned so that the interior cavity is exposed. The pocket is disposed on the closure flap and includes an opening that is disposed in the closed interior volume when the closure flap is in the closed position. The magnetic cover closure is disposed adjacent a closure edge of the second portion of the closure flap and the cover closure releasably couples the second portion of the closure flap to the cover body when the closure flap is in the closed position. The pocket closure releasably retains the pocket opening in a closed configuration and the opening is oriented parallel to the closure edge.

In a further embodiment, a golf club head cover includes a cover body, a closure flap, a pocket, a cover closure, a pocket closure, a pocket pull tab and a cover pull tab. The cover body defines an interior cavity. The closure flap includes a first portion that is coupled to the cover body and a second portion that is movable between a closed position and an opened position. In the closed position, the closure flap covers an opening to the interior cavity so that the cover body and the closure flap define a closed interior volume. The pocket is disposed on the closure flap and includes an elongate opening. The cover closure releasably retains the closure flap in the closed position. The pocket closure releasably retains the pocket closed. The pocket pull tab is coupled to the pocket adjacent the opening and the cover pull tab is coupled to an edge of the closure flap adjacent the pocket pull tab when the pocket is closed.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
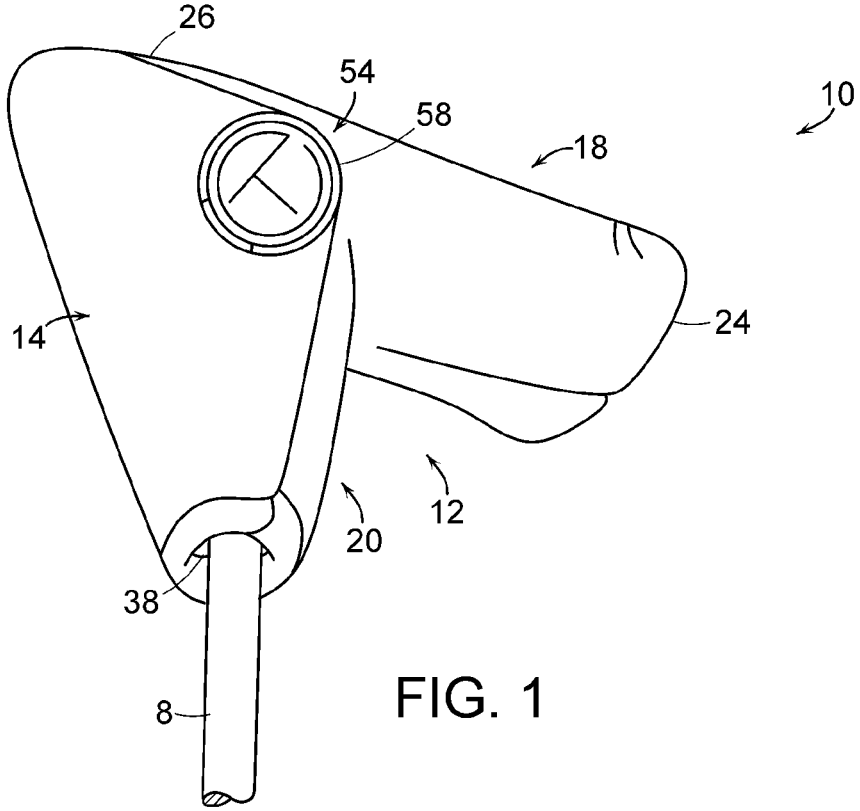
FIG. 1 is a perspective view of an embodiment of a golf club head cover in accordance with the present invention installed on an exemplary golf club and including a closure flap in a closed position.

The present invention is directed to a cover for protecting the head of a golf club that includes storage. Such a system can be utilized to provide for secure and convenient storage of various small items. Several embodiments of the present invention are described below.

An embodiment of a golf club head cover 10 in accordance with the present invention is illustrated in FIGS. 1-4. Head cover 10 includes a body 12, a closure flap 14 and a storage pocket 16. Body 12 includes a head portion 18 and a shaft portion 20 that are fixed relative to each other. The combined head portion 18 and shaft portion 20 define an interior cavity 22 that receives the head and a portion of shaft 8 of a golf club. Head portion 18 and shaft portion 20 are oriented so that body 12 is configured in the shape of an "L".

Head portion 18 is generally tubular and is sized to receive the head of a golf club. Head portion 18 includes a toe end 24 and a heel end 26. Toe end 24 receives the toe of the club head and heel end 26 receives the heel of a golf club. Head portion 18 preferably includes an interior lining 28 that is selected to protect the head of the club head during insertion and removal of the club head. In the present embodiment, heel end 26 of head portion 18 is opened so that the club head may be slidably inserted and removed from head portion 18.

Shaft portion 20 is partially tubular and is sized to partially encircle a portion of shaft 8 that is immediately adjacent the head of the golf club. Shaft portion 20 includes a heel side 30 that is generally oriented toward heel end 26 of head portion 18 and a toe side 32 that is generally oriented toward toe end 24 of head portion 18. In the present embodiment, heel side 30 of shaft portion 20 is opened so that the portion of shaft 8 adjacent the club head is received in shaft portion 20 when the club head is slid into head portion 18 from heel end 26. As a result, head cover 10 is configured as a "rear" or "heel" entry cover. Additionally, shaft portion 20 includes a head end 34 that is disposed adjacent head portion 18 and a shaft end 36 that is disposed opposite head end 36 and provides a throughway for shaft 8 of the golf club, when the club head is inserted into cover 10.

In the present embodiment, head portion 18 and shaft portion 20 are constructed from a single piece of material so that they are fixed relative to each other. It should be appreciated that head portion 18 and shaft portion 20 may be separate components that are coupled to each other, such as by stitching or bonding so that they are fixed relative to each other. Furthermore, body 12 may be constructed from any number of components that are fixed relative to each other. Moreover, the body of the head cover may be constructed from any flexible, rigid or semi-rigid, elastic or non-elastic material. In the present embodiment, body 12 is configured in the illustrated shape from a single piece of flexible material, such as soft leather or nylon.

Figure 2:
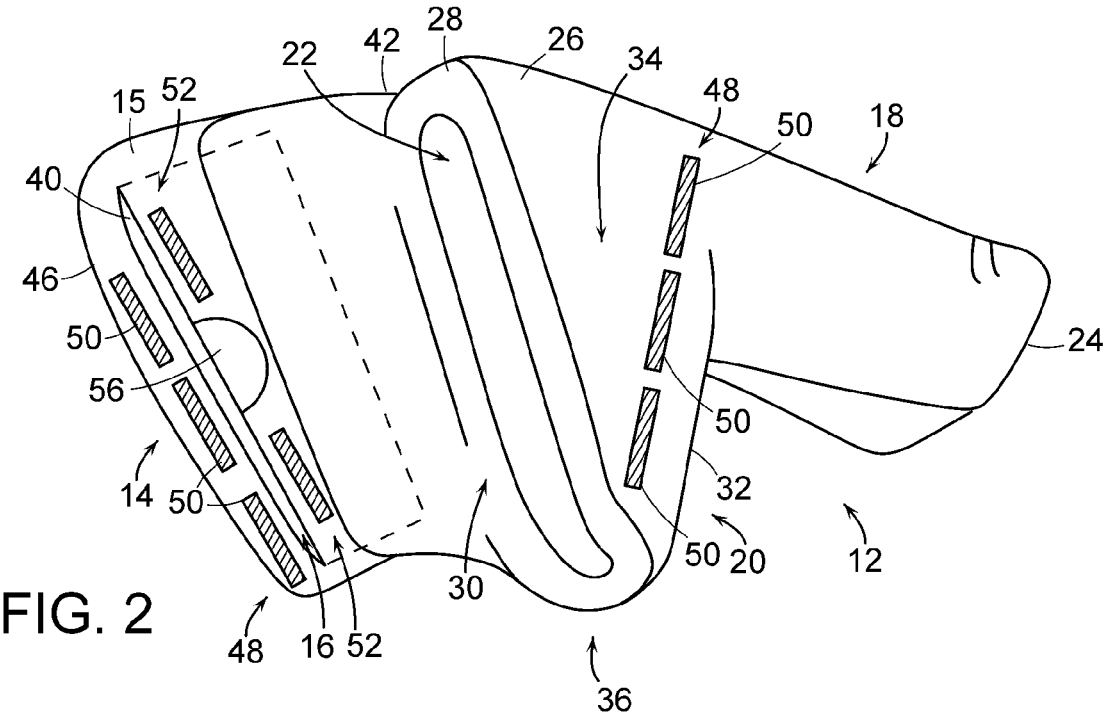
FIG. 2 is a perspective view of the head cover of FIG. 1 with the closure flap in an opened position.
Figure 3:
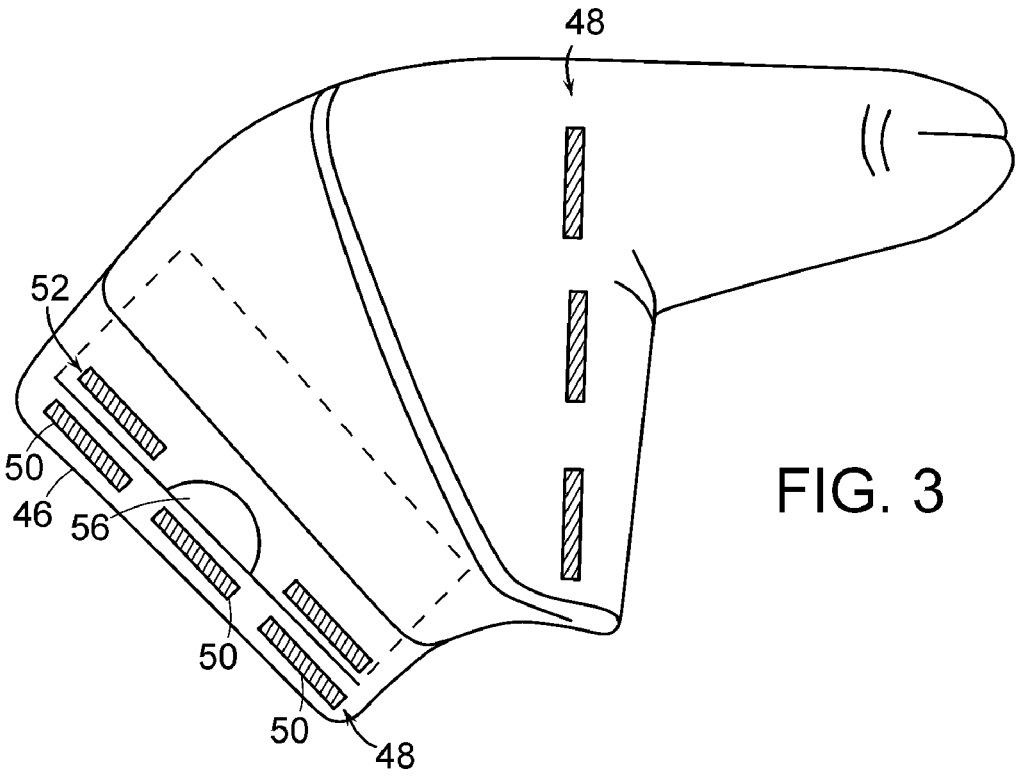
FIG. 3 is a side view of the head cover of FIG. 1.
Figure 4:
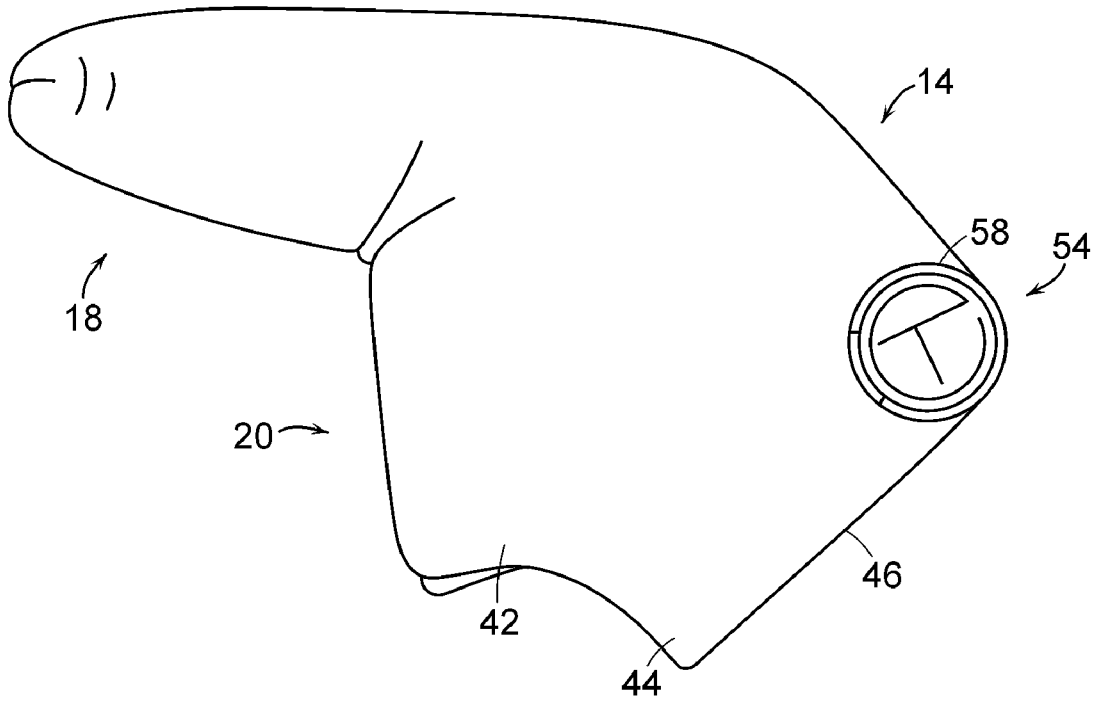
FIG. 4 is another side view of the head cover of FIG. 1.

Closure flap 14 is used to selectively retain the golf club head within cover 10. In particular, closure flap 14 is movable between a first, closed position, as shown in FIG. 1, and a second, opened position, as shown in FIGS. 2-4. In the closed position, closure flap 14 is positioned over the openings in heel end 26 of head portion 18 and heel side 30 of shaft portion 20 to substantially enclose cavity 22, thereby defining a closed interior volume of head cover 10. Additionally, in the closed position, closure flap 14 conceals an opening 40 of storage pocket 16 within the closed interior volume of head cover 10.

It should be appreciated that cavity 22 is not fully enclosed when closure flap 14 is in the closed position, because in that position, shaft end 36 of shaft portion 20 and closure flap 14 define a shaft aperture 38 that provides a throughway for shaft 8 when the club head is inserted into cover 10. Therefore, as used herein, the phrase "closed interior volume" is intended to describe the substantially enclosed cavity that receives the head of a golf club, which may include a throughway for a shaft of the golf club (e.g., aperture 38).

In the opened position, closure flap 14 is positioned away from the openings in heel end 26 of head portion 18 and heel side 30 of shaft portion 20 so that cavity 22 is exposed. The opened position of closure flap 14 allows a user to easily insert the head and a portion of the shaft of a golf club into head cover 10. Additionally, the opened position of closure flap 14 provides a user access to opening 40 of storage pocket 16.

In the present embodiment, closure flap 14 is constructed from a flexible material, such as leather. A first portion 42 of closure flap 14 is fixed relative to body 12 and a second portion 44 of closure flap 14 forms a free end that terminates in a closure edge 46. The flexibility of closure flap 14 allows a user to wrap closure flap 14 around heel end 26 of head portion 18 and heel side 30 of shaft portion 20 to place closure flap 14 in the closed position. The flexibility also allows a user to bend closure flap 14 away from body 12 to gain easy access to opening 40 of storage pocket. It should be appreciated, however, that the closure flap may be constructed from a rigid or semi-rigid material that is hinged or bendable so that the closure flap is movable between the opened and closed positions.

Figure 10:
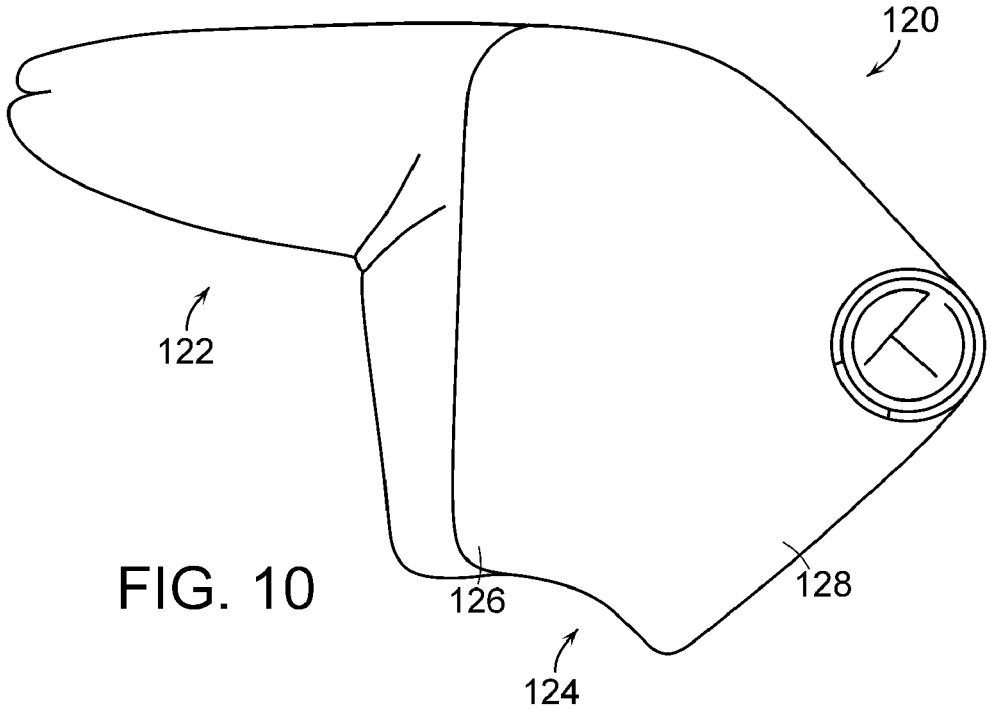
FIG. 10 is another side view of the head cover of FIG. 7.

The closure flap and the cover body may be constructed from a single piece of material, as shown in FIG. 4, or the closure flap may be constructed from a piece of material separate from that of the cover body, as shown in FIG. 10. In embodiments utilizing a separate closure flap, the closure flap may be fixed relative to the body by any method of attachment, such as stitching, bonding, rivets, etc. Additionally, if a separate closure flap is employed, the closure flap and body may be constructed from the same or different materials.

Storage pocket 16 is integrated into closure flap 14 and provides storage for small items, such as ball markers, pencils, divot repair tools, etc. Storage pocket 16 is located so that it is concealed when closure flap 14 is in the closed position. In particular, opening 40 of storage pocket 16 is concealed in the closed interior volume of head cover 10 when closure flap 14 is in the closed position. That location of storage pocket 16 provides additional security for items disposed in storage pocket 16 because it reduces the likelihood that storage pocket 16 is inadvertently opened. Additionally, the location of storage pocket 16 reduces the visibility of pocket 16 which may provide additional security and improved aesthetics of head cover 10.

Storage pocket 16 may be disposed between closure flap 14 and a lining material 15 located on an inner surface of closure flap 14 so a slit in lining material 15, or a separation between closure flap 14 and lining 15, forms opening 40. Alternatively, storage pocket 16 may be a piece of material that is coupled to an inner surface of closure flap 14 or to lining material 15 located on an inner surface of closure flap 14. Additionally, although storage pocket 16 is generally rectangular in shape, it should be appreciated that the storage pocket may have any desired shape. For example, the storage pocket may be rectangular, square, circular, semi-circular or any other polygonal or curved shape.

A cover closure 48 is provided that allows second portion 44 of closure flap 14 to be selectively and releasably coupled to body 12. Cover closure 48 may be any mechanism that selectively retains closure flap 14 in the closed position. In the present embodiment, cover closure 48 is a magnetic retention device. In particular, cover closure 48 includes magnets 50 disposed in both body 12 and closure flap 14. Magnets 50 are oriented so that magnets 50 of body 12 are attracted to magnets 50 of closure flap 14 when body 12 and second portion 44 of closure flap 14 are placed in close proximity to each other. Alternatively, magnets 50 may be included in one of body 12 and closure flap 14 and ferromagnetic material may be incorporated into the other of body 12 and closure flap 14 so that magnets 50 and the ferromagnetic material are attracted to each other when placed in close proximity. Preferably, magnets 50 are selected to provide an audible and/or a tactile indication of attachment between closure flap 14 and body 12 when a user moves closure flap 14 into the closed position. For example, the magnets are selected so that the magnetic attraction is strong enough to create a "snap" sound when the closure flap 14 becomes attached to body 12.

As further alternatives, cover closure 48 may one or more hook and loop fasteners, snap fasteners, clips and/or straps that allow a user to selectively secure second portion 44 of closure flap 14 to body 12. In embodiments utilizing a rigid or semi-rigid closure flap, any of the types of cover closure described above may be incorporated in addition, or as alternatives, to hinges that are spring-biased or bi-stable.

A pocket closure 52 is included adjacent opening 40 of storage pocket 16 so that storage pocket 16 may be selectively opened and closed. Pocket closure 52 may be any mechanism that selectively and releasably retains opening 40 in a closed configuration. Pocket closure 52 may employ one or more magnets, hook and loop fasteners, clips, straps, zippers and/or spring-biased hoops. Additionally, cover closure 48 and pocket closure 52 may include shared components. For example, in an embodiment, cover closure 48 includes magnets 50 located in closure flap 14 and ferromagnetic material is included in storage pocket 16 adjacent opening 40 as well as within body 12 so that storage pocket 16 is held closed and closure flap 14 is held in the closed position using the same magnets.

As shown in FIGS. 2 and 3, storage pocket 16 is oriented so that opening 40 is adjacent and parallel to closure edge 46 of closure flap 14. In that orientation, lining 28 of head portion 18 may extend onto closure flap 14 without interfering with opening 40 of storage pocket 16. Additionally, orienting opening 40 parallel to closure edge 46 of closure flap 14 results in opening 40 being vertically oriented when head cover 10 is mounted on a golf club that is stored in a golf bag. As a result, items stored in storage pocket 16 are less likely to fall out of storage pocket 16.

Closure flap 14 may also include a cover pull tab 54. Cover pull tab 54 provides a convenient and durable grasping surface for a user to disengage cover closure 48 and to move closure flap 14 from the closed position toward the opened position. In the present embodiment, cover pull tab 54 is located on a corner of closure flap 14 adjacent closure edge 46 and shaped so that it matches the curvature of the edge of closure flap 14. The cover pull tab may be located in any position on the closure flap. Additionally, the cover pull tab may be constructed from any durable material and may be any size and shape. For example, suitable materials include leather, nylon, plastic, rubber, metal etc. Preferably, the cover pull tab is sized and shaped to be comfortably grasped by a user between their thumb and forefinger.

Similarly, storage pocket 16 may include a pocket pull tab 56 that provides a convenient and durable grasping surface for a user to open storage pocket 16. Pocket pull tab 56 may be located on any portion of storage pocket 16, but is preferably disposed adjacent the center of opening 40. Additionally, pocket pull tab 56 may be oriented so that in a rest condition it extends in any direction. For example, pocket pull tab 56 may be configured so that it extends from opening 40 toward storage pocket 16 and cavity 22, as shown in FIGS. 2 and 3, so that pocket pull tab 56 overlaps storage pocket 16 when pocket pull tab 56 is at rest. That orientation allows a user to easily grasp closure edge 46 and pocket pull tab 56 simultaneously to open storage pocket 16. Pocket pull tab 56 may be constructed from any durable material such as leather, nylon, plastic, rubber, metal, etc. and pocket pull tab 56 is preferably sized and shaped to be comfortably grasped by a user between their thumb and forefinger.

Head cover 10 may optionally include a ball marker holder 58. Ball marker holder 58 may be located anywhere on or in head cover 10. For example, ball marker holder 58 may be integrated into cover pull tab 54, as shown in FIGS. 1 and 4-6. In the present embodiment, ball marker holder 58 is a magnetic ball marker holder that is integrated into cover pull tab 54.

In the illustrated embodiment, head cover 10 is configured as a putter head cover. An advantage of providing a ball marker holder integrated into a pull tab on a putter head cover is that when the player retrieves their putter from their golf bag, and removes the head cover, they are forced to touch the ball marker, thereby providing a tactile reminder immediately before they are likely to need a ball marker.

Figure 5:
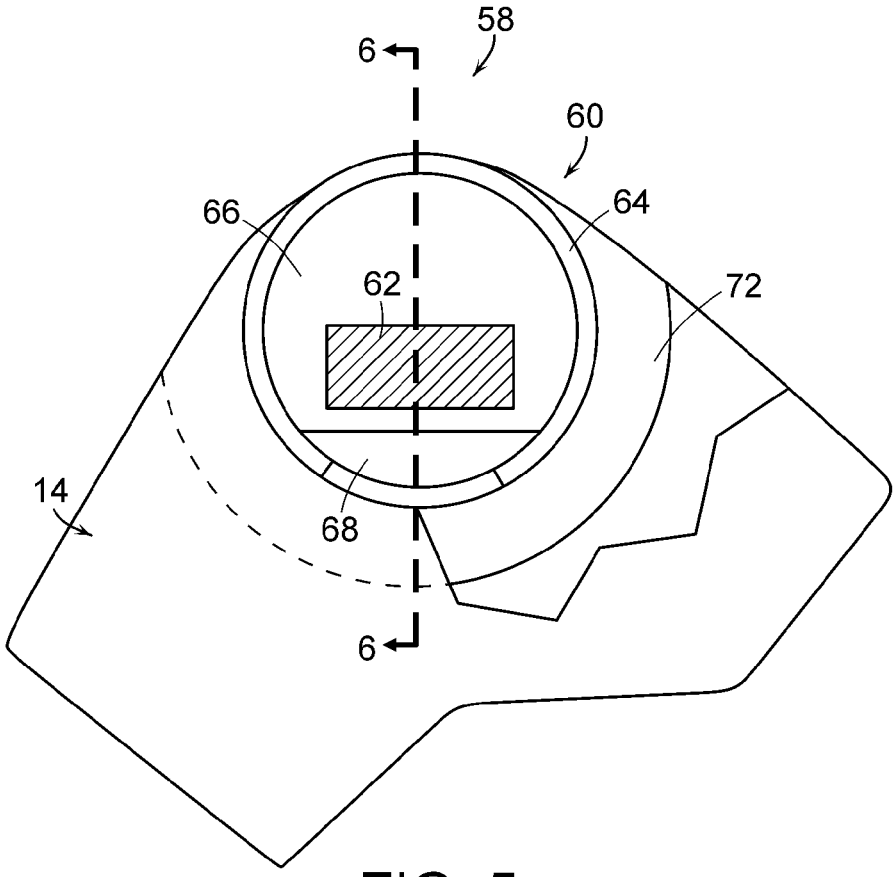
FIG. 5 is a side view of a portion of the closure flap of the head cover of FIG. 1.
Figure 6:
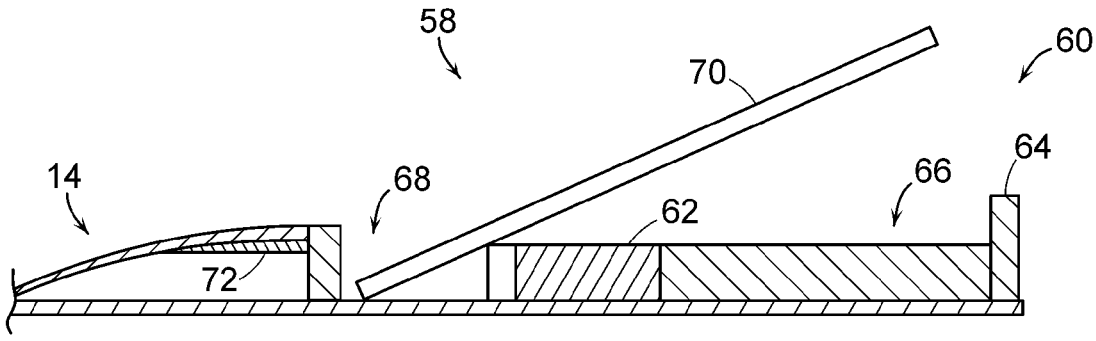
FIG. 6 is a cross-sectional view of the portion of the closure flap shown in FIG. 5, taken along line 6-6, including a ball marker.

Referring to FIGS. 5 and 6, an exemplary embodiment of ball marker holder 58 will be described. Ball marker holder 58 is attached to closure flap 14 adjacent closure edge 46 and includes a holder body 60 and a holder magnet 62. Holder body 60 includes a retaining wall 64 that surrounds a holder base 66. Holder base 66 extends across a portion of the interior space created by retaining wall 64 so that an opening 68 remains between a portion of retaining wall 64 and a portion of holder base 66. In the present embodiment, retaining wall 64 is generally annular so that it is configured to receive a circular ball marker 70. However, it should be appreciated that retaining wall 64 may be constructed in any shape to complement the shape of any desired ball marker.

Holder body 60 is sized and shaped so that ball marker 70 is received in retaining wall 64 and overlaps holder base 66 and opening 68. Holder magnet 62 is integrated into holder base 66 and is located generally adjacent to opening 68. At least a surface of ball marker 70 is constructed of a ferrous metal that is attracted to holder magnet 62 so that ball marker 70 is retained within holder body 60 by magnetic attraction when no other forces are placed on ball marker 70. The location of holder magnet 62 adjacent opening 68 assures that when a user presses on the portion of ball marker 70 overlapping opening 68, the ball marker 70 is moved away from holder magnet 62 and ball marker is easily removed from holder body 60, as shown in FIG. 6.

Holder body 60 also includes a flange that extends radially outward from at least a portion of retaining wall 64. Flange 72 provides a structure for coupling holder body 60 to a substrate, such as closure flap 14. In the present embodiment, flange 72 extends radially outward from a majority of the circumference of retaining wall 64 and is shaped to match the shape of closure flap 14. Although an exemplary magnetic ball marker holder has been described, it should be appreciated that any type of ball marker holder may be employed.

Figure 7:
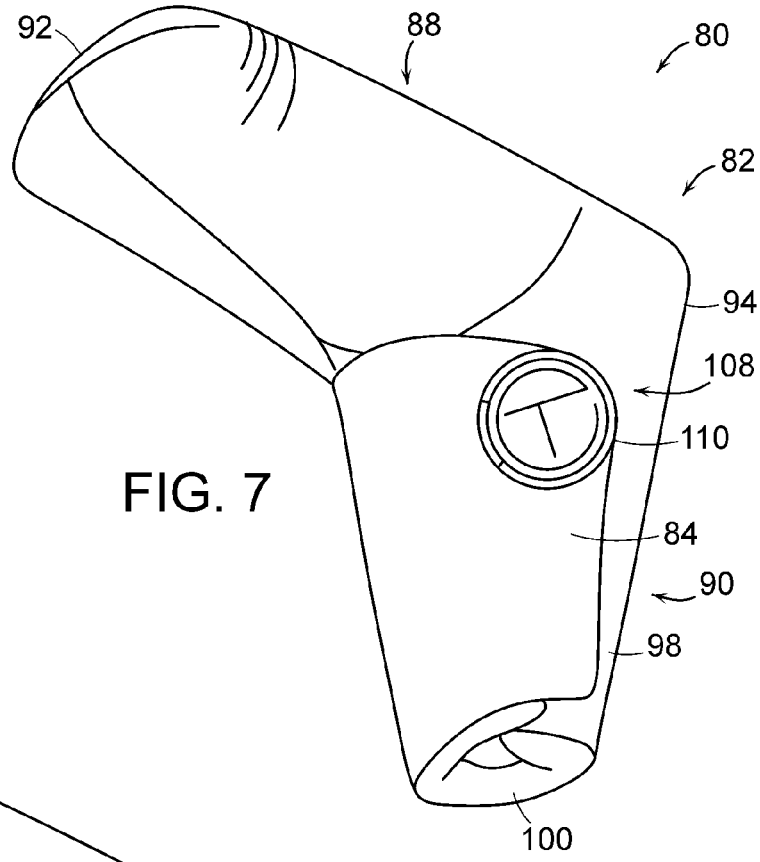
FIG. 7 is a perspective view of another embodiment of a golf club head cover including a closure flap in a closed position.
Figure 8:
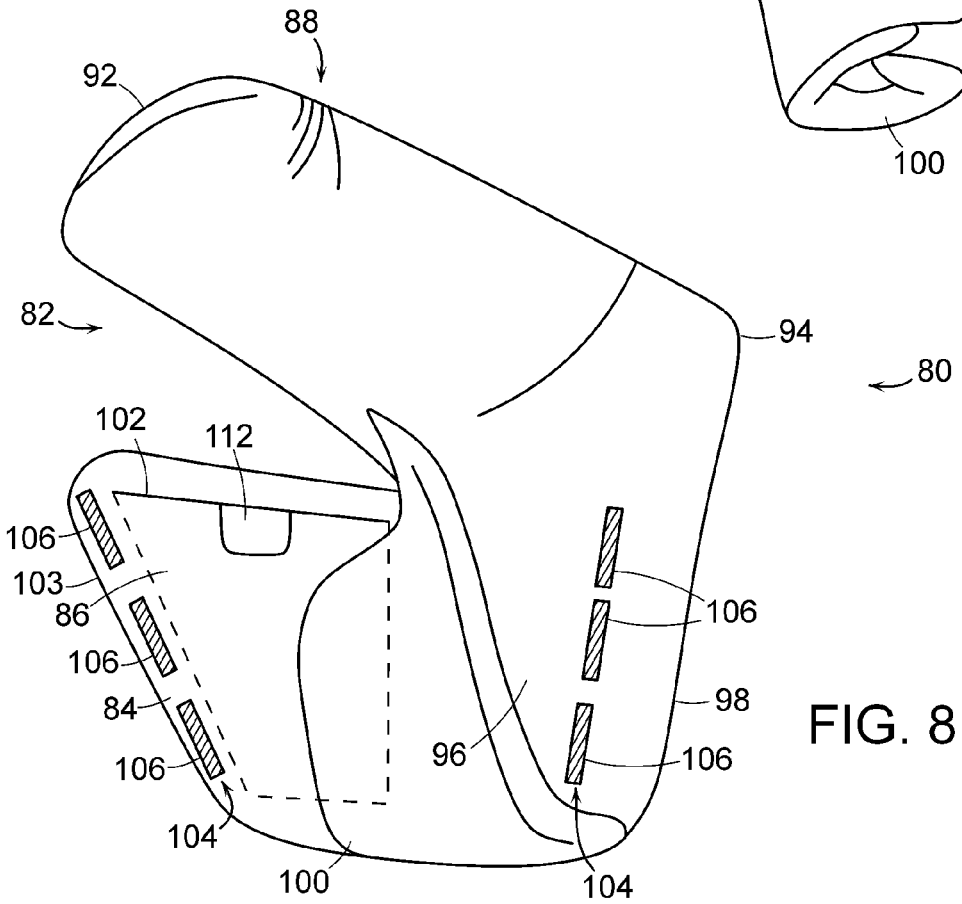
FIG. 8 is a perspective view of the head cover of FIG. 7 with the closure flap in an opened position.
Figure 9:
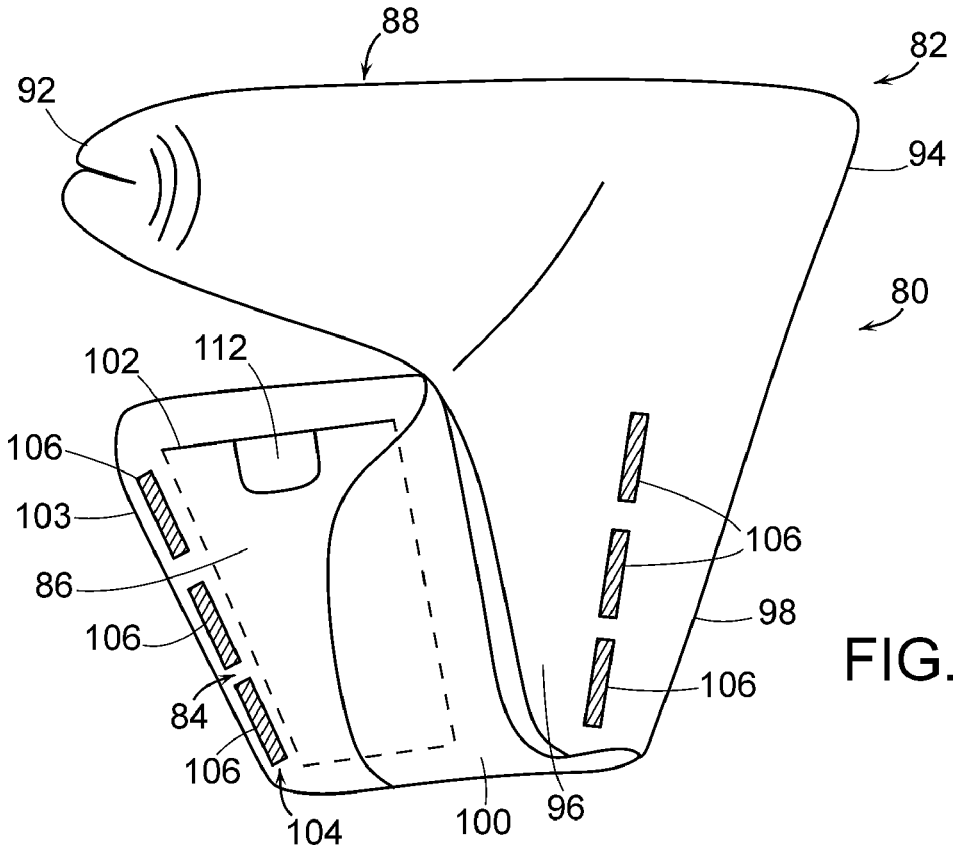
FIG. 9 is side view of the head cover of FIG. 7.

Referring to FIGS. 7-9, another embodiment of the head cover will be described. Head cover 80 generally includes a body 82, a closure flap 84 and a storage pocket 86. Body 82 includes a head portion 88 that is configured to receive the head of a golf club and a shaft portion 90 that is configured to receive a portion of the shaft of a golf club. Head portion 88 is fixed relative to shaft portion 90 so that body 82 is configured in the shape of an "L".

Head portion 88 is generally tubular and is sized to receive the head of a golf club. Shaft portion 90 is partially tubular and is sized to partially encircle a portion of a golf club shaft that is immediately adjacent the head of the club. In the present embodiment, there is no opening in either a toe end 92 or a heel end 94 of head portion 88. However, a toe side 96 of shaft portion 90 is open so that a portion of a shaft of a golf club shaft is received by a heel side 98 of shaft portion when the club head is inserted into head cover 80. In particular, the club head is inserted into head portion 88 of head cover 80, toe end first, through toe side 96 of shaft portion 90. As a result, head cover 80 is configured as a "front" or "toe" entry cover. An interior lining 100 may be included on any portion of the interior surface of head cover 80 to protect the club head and shaft during insertion and removal.

Closure flap 84 is used to selectively retain the golf club head within cover 80 and is movable between a first, closed position, as shown in FIG. 7, and a second, opened position, as shown in FIGS. 8 and 9. Because of the front entry style of head cover 80, in the closed position, closure flap 84 is positioned over the opening in toe side 96 of shaft portion 90. Closure flap 84 includes a cover closure 104 that includes a plurality of magnets 106, but it should be appreciated that cover closure 104 may have any structure, including those described with regard to any of the other embodiments herein.

Storage pocket 86 is integrated into closure flap 84 to provide storage for small items. Storage pocket 86 is configured so that an opening 102 is concealed when closure flap 84 is in the closed position. As described with regard to other embodiments, storage pocket 86 may be configured so that opening 102 has any desired orientation relative to a closure edge 103 of closure flap 84. For example, in the present embodiment, storage pocket 86 is configured so that opening 102 is oriented generally perpendicular to closure edge 103. As a result, when head cover 120 is disposed on a golf club and the club is in a golf bag, opening 102 is oriented generally horizontally and at the top of storage pocket 86, thereby preventing items from slipping out of storage pocket 86. Storage pocket 86 includes a pocket closure (not shown) that may have any structure, including those described with regard to any of the other embodiments herein.

Moreover, it should be appreciated that head cover 80 may include a cover pull tab 108, a ball marker holder 110 that may, but need not, be integrated into cover pull tab 108 (as shown), and pocket pull tab 112. It should be appreciated that those features may have any structure, including those described with regard to any of the other embodiments herein.

In another embodiment, shown in FIG. 10, head cover 120 includes a body 122 and a separate closure flap 124. Closure flap 124 is constructed from a piece of material that is separate from body 122 and is coupled to body 122 so that it is fixed relative to body 122. In particular, a first portion 126 of closure flap 124 is attached to body 122 along an edge of closure flap 124. Any method of securing closure flap 124 to body 122 may be employed. For example, closure flap 124 may be stitched and/or bonded to body 122. A second portion 128 of closure flap 124 forms a free end of closure flap 124 that is selectively and releasably secured to body 122 during use. The remainder of head cover 120 is substantially identical to the embodiment described above with regard to FIGS. 1-4, and therefore, will not be described in further detail.

Figure 11:
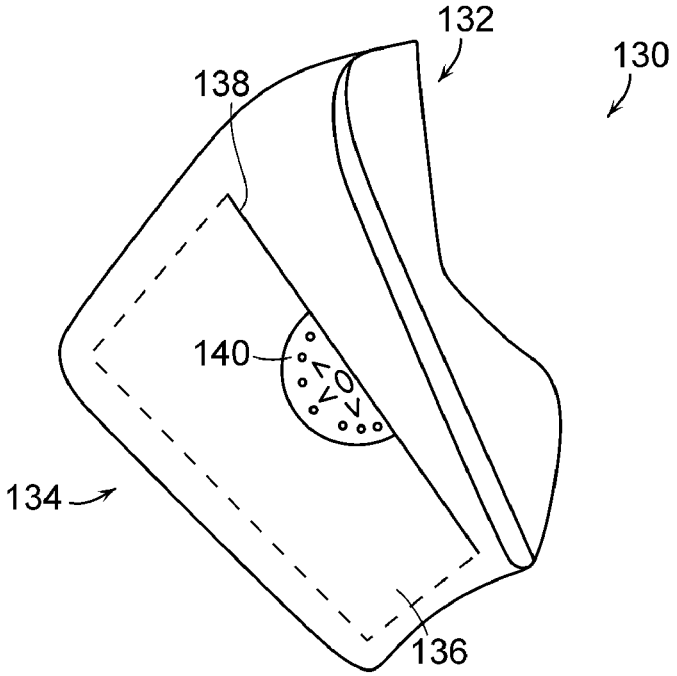
FIG. 11 is a side view of a portion of another embodiment of a head cover in accordance with the present invention.
Figure 12:
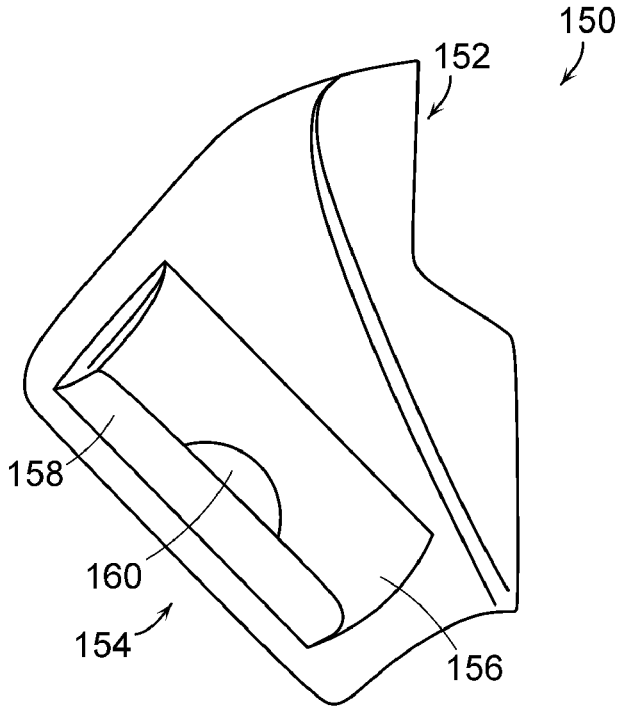
FIG. 12 is a side view of a portion of a further embodiment of a head cover in accordance with the present invention.

Referring now to FIGS. 11 and 12, alternative embodiments of the storage pocket will be described. As shown in FIG. 11, head cover 130 includes a cover body 132, a closure flap 134 and a storage pocket 136. Body 132 is fixed relative to a first portion of closure flap 134 and a second portion of closure flap is movable between a closed position and an opened position. The structure of body 132 and closure flap 134 are substantially identical to those described with regard to other embodiments and will not be further described.

Storage pocket 136 is oriented so that an opening 138 is generally parallel to a closure edge 140 of closure flap 134. Additionally, opening 138 is spaced from closure edge 140 toward the attachment between the first portion of closure flap 134 and cover body 132.

A pocket pull tab 140 is coupled to storage pocket 136 adjacent opening 138. Pocket pull tab 140 is coupled to storage pocket 136 so that it overlaps storage pocket 136 and extends from opening 138 when pocket pull tab 140 is at rest. It should be appreciated that pocket pull tab 140 may be coupled to any portion of storage pocket 136 and may have any desired configuration.

The orientation of storage pocket 136 and opening 138 allows a user to easily open storage pocket 136 while a golf club head is inserted in head cover 130 and closure flap 134 is in an opened position. In particular, a user may grasp the shaft of the golf club with one hand while grasping pocket pull tab 140 of storage pocket 136 with the other hand and by pulling the two in opposite directions may open storage pocket 136. Additionally, that storage pocket configuration may also simplify use when head cover 130 is separate from a golf club by allowing the user to grasp cover body 132 with one hand and pocket pull tab 140 of storage pocket 136 with the other to open storage pocket 136.

In another embodiment, shown in FIG. 12, head cover 150 includes a storage pocket 156 that is coupled to an inner surface of a closure flap 154. Similar to the previously described embodiments, a first portion of closure flap 154 is fixed relative to a cover body 152 that is sized to receive a golf club head. However, in the previous embodiments, the storage pocket was generally disposed between the closure flap and a lining material disposed on the inner surface of the closure flap.

As shown, storage pocket 156 is an envelope of material that is coupled to an inner surface of closure flap 154 so that storage pocket 156 has increased width. A pocket flap 158 is included that is configured to fold over an opening of storage pocket 156 and a pocket pull tab 160 is provided on pocket flap 158 to provide a convenient grasping feature for a user to move pocket flap 158 and to open storage pocket 156. It should be appreciated that a pocket closure is provided between flap 158 and the envelope portion of storage pocket 156 so that flap 158 may be retained in a closed position.

Figure 13:
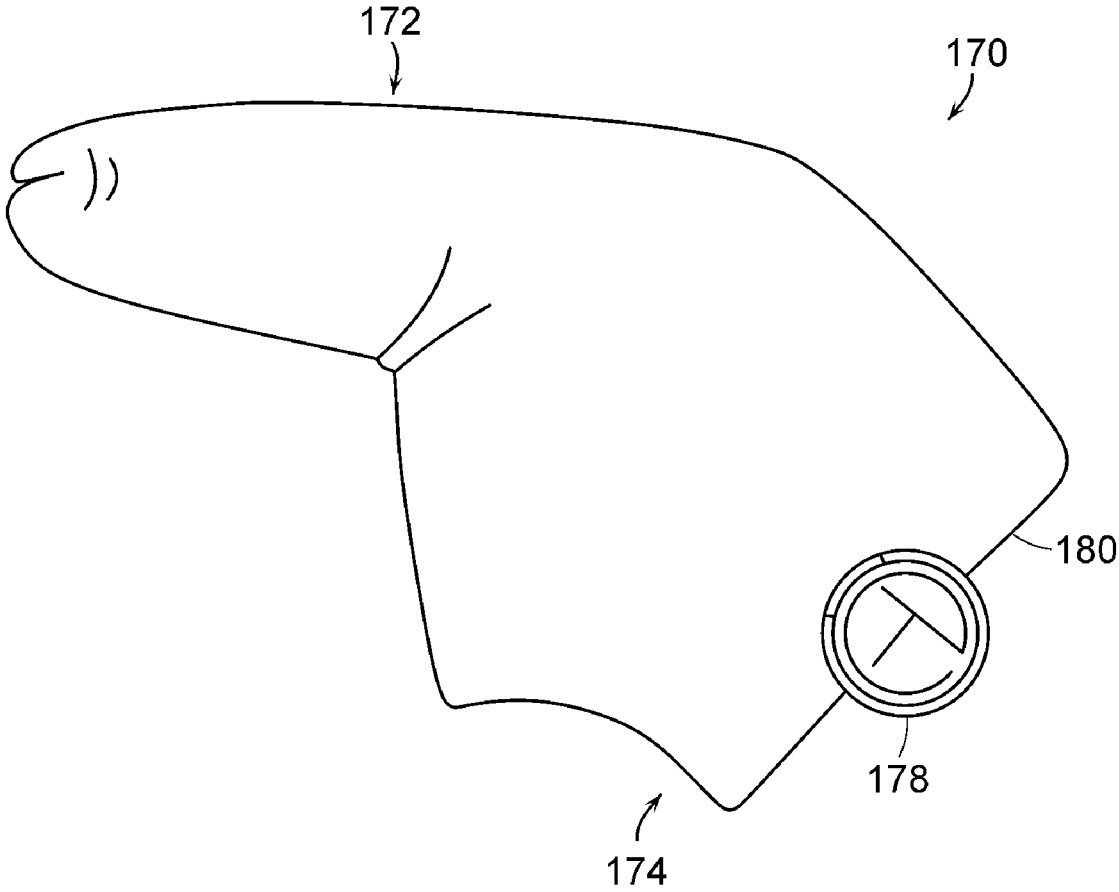
FIG. 13 is a side view of a still further embodiment of a head cover in accordance with the present invention.
Figure 14:
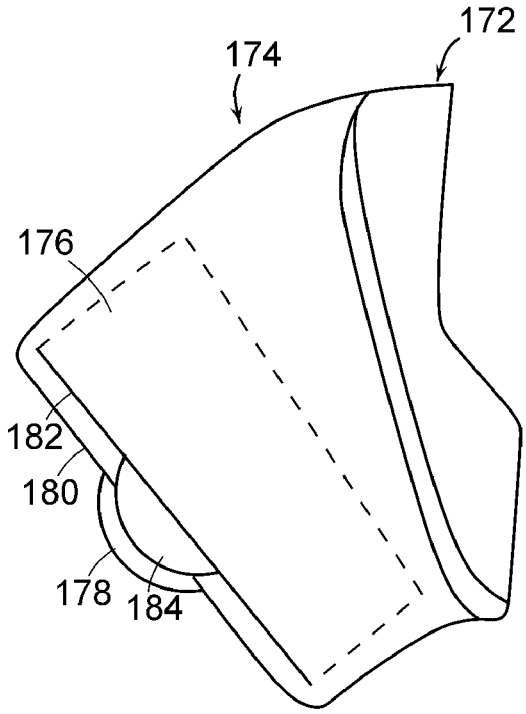
FIG. 14 is a side view of a portion of the head cover of FIG. 13, illustrating an embodiment of a pocket pull tab.
Figure 15:
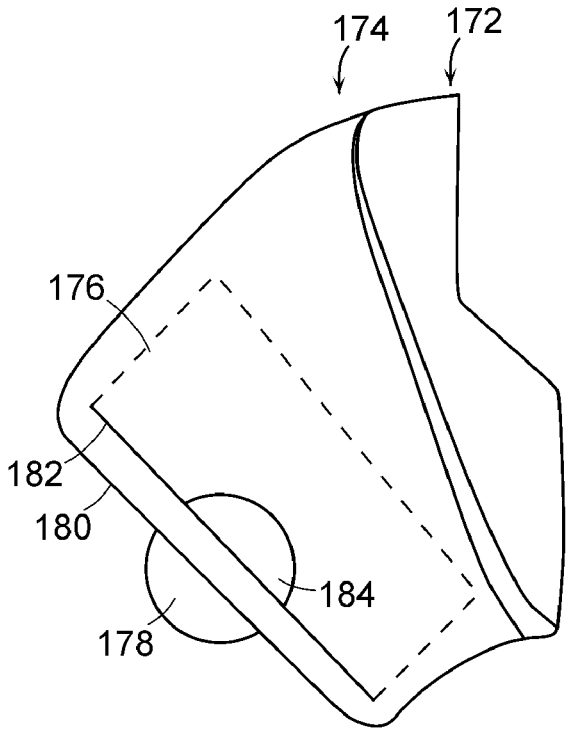
FIG. 15 is a side view of a portion of the head cover of FIG. 13, illustrating another embodiment of a pocket pull tab.

Referring now to FIGS. 13-15, additional embodiments of the cover pull tab and pocket pull tab will be described. Head cover 170 includes a cover body 172, a closure flap 174 and a storage pocket 176. Body 172, closure flap 174 and storage pocket 176 are generally constructed in accordance with the previously described embodiments. However, in the present embodiment an alternative configuration of a cover pull tab 178 is illustrated. In particular, cover pull tab 178 is positioned at an intermediate location along a closure edge 180 of closure flap 174. That intermediate position of cover pull tab 178 allows cover pull tab to be located adjacent and to complement a pocket pull tab included on storage pocket 176. Cover pull tab 178 may also incorporate an integrated ball marker holder as described above, if desired.

As illustrated, storage pocket 176 is oriented so that an opening 182 is disposed generally adjacent to and parallel with closure edge 180. In an embodiment, illustrated in FIG. 14, pocket 176 includes pocket pull tab 184 that is adjacent and at least partially overlaps opening 182 and cover pull tab 178. In that configuration, a user may easily open storage pocket 176 by grasping and moving cover pull tab 178 and pocket pull tab 184 away from each other.

In another embodiment, storage pocket 176 includes pocket pull tab 186 that is adjacent cover pull tab 178, but extends away from cover pull tab 178 so that it overlaps storage pocket 176. The orientation of pocket pull tab 186 may be more convenient for a user to simultaneously grasp cover pull tab 178 and pocket pull tab 186 because the two are spaced from each other when they are at rest.

Although in the illustrated embodiments, the inventive head cover is configured for a putter, it should be appreciated that the head cover may be configured for any type of golf club. For example, other embodiments of the inventive head cover include configurations particularly suited for drivers, utility clubs, hybrids and iron-type golf clubs.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

I claim:

1. A golf club head cover, comprising:

a cover body defining an interior cavity, wherein the interior cavity is shaped to receive a golf club head, and the cover body defines an opening into the interior cavity;

a closure flap that does not define the interior cavity of the cover body, wherein the closure flap includes a first portion that is fixed relative to the cover body adjacent the opening to the interior cavity defined by the cover body and a second portion that is movable between a closed position and an opened position, wherein the closure flap covers the opening to the interior cavity so that the cover body and the closure flap define a closed interior volume in the closed position to retain the golf club head in the interior cavity;

a pocket disposed on the closure flap and including a pocket opening that is disposed in the closed interior volume when the closure flap is in the closed position;

a cover closure that releasably retains the closure flap in the closed position; and a pocket closure that releasably retains the pocket closed.

2. The golf club head cover of claim 1, wherein the closure flap includes a closure edge that is adjacent the cover closure and the pocket opening is disposed adjacent and parallel to the closure edge.

3. The golf club head cover of claim 1, wherein the closure flap includes a closure edge that is adjacent the cover closure and the pocket opening is disposed perpendicular to the closure edge.

4. The golf club head cover of claim 1, wherein the closure flap includes a closure edge that is adjacent the cover closure, and the pocket opening is disposed adjacent the first portion of the closure flap and parallel to the closure edge.

5. The golf club head cover of claim 1, further comprising a golf ball marker holder coupled to the closure flap.

6. The golf club head cover of claim 1, further comprising a pocket pull tab coupled to the pocket adjacent the pocket opening.

7. The golf club head cover of claim 6, wherein the pocket pull tab extends toward the pocket so that it overlaps the pocket when the pocket pull tab is at rest.

8. The golf club head cover of claim 6, wherein the pocket pull tab extends away from the pocket so that it overlaps the pocket opening when the pocket pull tab is at rest.

9. The golf club head cover of claim 1, further comprising a cover pull tab coupled to the second portion of the closure flap.

10. The golf club head cover of claim 9, further comprising a golf ball marker holder integrated into the cover pull tab.

11. The golf club head cover of claim 9, wherein the closure flap includes a closure edge that is adjacent the cover closure, and the cover pull tab is coupled to the second portion of the closure flap at an intermediate location along the closure edge.

12. The golf club head cover of claim 9, further comprising a pocket pull tab coupled to the pocket adjacent the pocket opening.

13. The golf club head cover of claim 12, wherein the pocket pull tab is adjacent the cover pull tab when the pocket is closed.

14. A golf club head cover, comprising:

a cover body defining an interior cavity, wherein the interior cavity is shaped to receive a golf club head, and the cover body defines an opening into the interior cavity;

a closure flap that does not define the interior cavity of the cover body, the closure flap including a first portion that is fixed relative to the cover body adjacent the opening to the interior cavity defined by the cover body, and a second portion that is movable relative to the first portion and the cover body between a closed position and an opened position, wherein the closure flap covers the opening to the interior cavity of the cover body so that the cover body and the closure flap define a closed interior volume in the closed position to retain the golf club head in the interior cavity, and wherein the closure flap is positioned so that the interior cavity is exposed in the opened position;

a pocket disposed on the closure flap and including a pocket opening that is disposed in the closed interior volume when the closure flap is in the closed position;

a magnetic cover closure disposed adjacent a closure edge of the second portion of the closure flap that releasably couples the second portion of the closure flap to the cover body when the closure flap is in the closed position; and a pocket closure that releasably retains the pocket closed, wherein the pocket opening is parallel to the closure edge.

15. The golf club head cover of claim 14, further comprising a pocket pull tab coupled to the pocket adjacent the pocket opening that extends toward the pocket so that it overlaps the pocket when the pocket pull tab is at rest.

16. The golf club head cover of claim 14, further comprising a pocket pull tab coupled to the pocket adjacent the pocket opening that extends away from the pocket so that it overlaps the opening when the pocket pull tab is at rest.

17. The golf club head cover of claim 14, further comprising a cover pull tab coupled to the second portion of the closure flap.

* * * * *